United States Patent [19]

Ando et al.

[11] Patent Number: 4,888,584

[45] Date of Patent: Dec. 19, 1989

[54] VECTOR PATTERN PROCESSING CIRCUIT FOR BIT MAP DISPLAY SYSTEM

[75] Inventors: Hisashige Ando, Yokohama; Makoto Katsuyama; Takahiro Sakuraba, both of Kawasaki, all of Japan

[73] Assignee: Fujitsu Limited, Kawasaki, Japan

[21] Appl. No.: 273,676

[22] Filed: Nov. 21, 1988

Related U.S. Application Data

[63] Continuation of Ser. No. 3,844, Jan. 16, 1987, abandoned.

[30] Foreign Application Priority Data

Jan. 20, 1986 [JP] Japan ..... 61-009564

[51] Int. Cl.[4] ..... G09G 1/14

[52] U.S. Cl. ..... 340/747; 340/744; 340/799

[58] Field of Search ..... 340/744, 747, 750, 736, 340/739, 798

[56] References Cited

U.S. PATENT DOCUMENTS

| | | | |
|---|---|---|---|
| 3,716,705 | 2/1973 | Newell | 340/736 |
| 3,735,389 | 5/1973 | Tarczy-Hornoch | 340/739 |
| 4,052,719 | 10/1977 | Hutt et al. | 340/728 |
| 4,566,002 | 1/1986 | Miura | 340/750 |
| 4,663,729 | 5/1987 | Matick et al. | 340/798 |
| 4,667,190 | 5/1987 | Fant et al. | 340/747 |
| 4,691,295 | 9/1987 | Erwin | 340/798 |

*Primary Examiner*—David K. Moore
*Assistant Examiner*—Jeffery A. Brier
*Attorney, Agent, or Firm*—Staas & Halsey

[57] ABSTRACT

A vector pattern processing circuit for a bit map display system including a display unit having a plurality of quasi regions in a matrix form defined in a plane of the display unit each forming N×N dots. The circuit includes first and second memory units each including a plurality of words formed in a matrix, each word having an N×N bits structure; the words in the first memory unit corresponding to diagonal quasi regions of the display unit and the words in the second memory unit corresponding other diagonal quasi regions; first and second word register units, each having an N×N bits structure; a digital differential analyzer (DDA) generating a first dot data of a primary axis for a processing vector pattern and a second dot data of a subsidiary axis perpendicular to the primary axis in response to a gradient of the vector pattern along the primary axis for every N dots in the primary axis. The circuit further includes a bit setting circuit energizing one of the word register units in response to the first and second dot data from the DDA and setting a bit defined by the dot data to the energized word register unit in each dot data generation time at the DDA; and a store control circuit addressing at least one address of a word in one of the memory unit defined by the coordinate, so that at least one of data set in one of the word register units is stored in the word defined by the address.

4 Claims, 10 Drawing Sheets

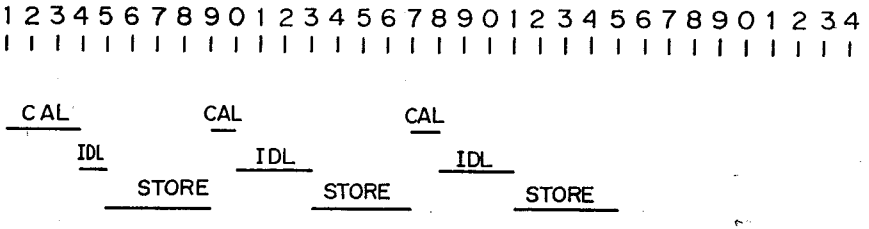
Fig. 3a
Fig. 3b
Fig. 3c
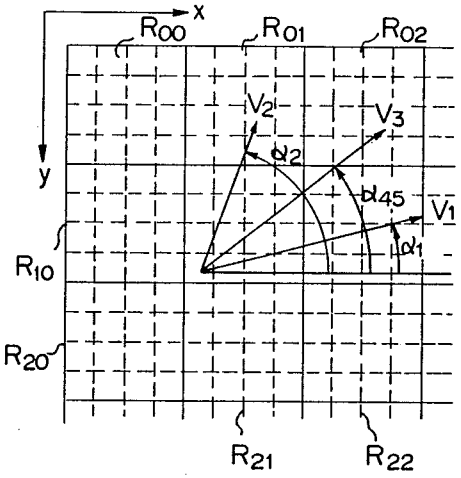
Fig. 5

$\alpha = 0°$ $\alpha = 45°$ $\alpha \doteqdot 28.5°$ $\alpha \doteqdot 37°$

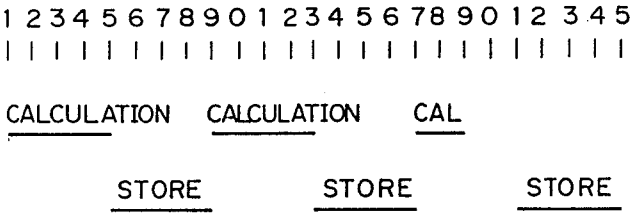
Fig. 12a MACHINE CYCLE
Fig. 12b DDA CYCLE
Fig. 12c MEMORY CYCLE
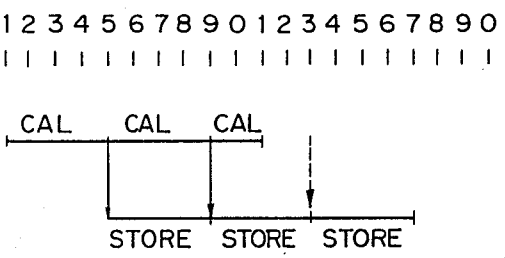
Fig. 13a MACHINE CYCLE
Fig. 13b DDA CYCLE
Fig. 13c MEMORY CYCLE

VECTOR PATTERN PROCESSING CIRCUIT FOR BIT MAP DISPLAY SYSTEM

This is a continuation of co-pending application Ser. No. 003,844, filed on Jan. 16, 1987, now abandoned.

BACKGROUND OF THE INVENTION

1. Field of the Invention

The present invention relates to a vector pattern processing circuit for a bit map display system.

2. Description of the Related Art

Bit map display systems are used for displaying a variety of display patterns, including characters, vectors, etc., on a display unit, such as a cathode ray tube (CRT) display unit. Previously, data was stored in a video memory consisting of a plurality of words, each word composed of a plurality of bits, and each bit corresponding to a dot or a picture element in the CRT display unit. The stored data was displayed on the CRT display unit by, for example, raster scanning.

In the bit map display system, a vector pattern processing circuit generates dot data in response to a start coordinate and an end coordinate and stores the data in the video memory. A variety of figures and patterns can be expressed by combining a variety of vector patterns, and therefore, the vector pattern processing circuit is frequently used for generating a variety of patterns.

The prior vector pattern processing circuits, however, suffer from the disadvantages of a low speed, an irregular timing control, and a complex circuit construction. These disadvantages will be described later with reference to the drawings

SUMMARY OF THE INVENTION

An object of the present invention is to provide a vector processing circuit with a high speed operation regardless of the shape of the vector pattern.

Another object of the present invention is to provide a vector processing circuit having a relatively simple circuit construction which achieves a high speed operation.

According to the present invention, there is provided a vector pattern processing circuit for a bit map display system including a display unit having a plurality of memory regions in a matrix form defined in a plane of the display unit, each forming N×N dots. The vector pattern processing circuit includes first and second memory units each including a plurality of words formed in a matrix fashion, each word having an N×N bits structure, the words in the first memory unit corresponding to first diagonal memory regions of the display unit and the words in the second memory unit corresponding to second diagonal memory regions of the display unit; first and second word register units, operatively connected to the first and second memory units, each having an N×N bits structure; and a vector pattern generation circuit receiving start and end coordinates in the memory regions defining a processing vector pattern, and generating a first dot data of a primary axis for the vector pattern and a second dot data of a subsidiary axis perpendicular to the primary axis in response to a gradient of the vector pattern with respect to the primary axis and along the primary axis for every N dots in the primary axis. The vector pattern processing circuit also includes a bit setting circuit, operatively connected between the first and second word register units and the vector pattern generation circuit, energizing one of the first and second word register units in response to the first and second dot data from the vector pattern generation circuit, and setting a bit defined by the first and second dot data to the energized word register unit in each dot data generation time at the vector pattern generation circuit; and a store control circuit, operatively connected to the first and second memory units and the vector pattern generation circuit, receiving the start coordinate and addressing at least one address of a word in one of the memory units defined by the start coordinate, so that at least one set of data in one of the word register units is stored in the word defined by the address.

The store control circuit may be capable of the addressing for one word defined by the coordinate and another word in another memory unit and corresponding to a quasi region of the display unit adjacent to a quasi region of the one word in the forward direction of the subsidiary axis, when the bit setting is effected to both word register units.

The coordinate in the store control circuit is updated in response to the generation of the first and second dot data at the vector pattern generation circuit.

Preferably, the vector pattern generation circuit may include a digital differential analyzer.

BRIEF DESCRIPTION OF THE DRAWINGS

Other objects and features of the present invention will be described below in detail with reference to the accompanying drawings, in which:

FIGS. 3*a* to 3*c* are timing charts of the operation of the vector pattern generation of the prior art bit map display system of FIG. 2;

FIG. 5 is a graph representing a rectangular-coordinate in a display unit of a present invention;

FIGS. 12*a* to 12*c* are timing charts of the vector pattern generation circuit of FIG. 10; and FIGS. 13*a* to 13*c* are timing charts of a pipe line vector pattern generation circuit of another embodiment of the present invention.

DESCRIPTION OF THE PREFERRED EMBODIMENTS

Before describing the peferred embodiments of the present invention, one example of a prior art system is described with reference to the drawings, for comparison.

Figure 1:
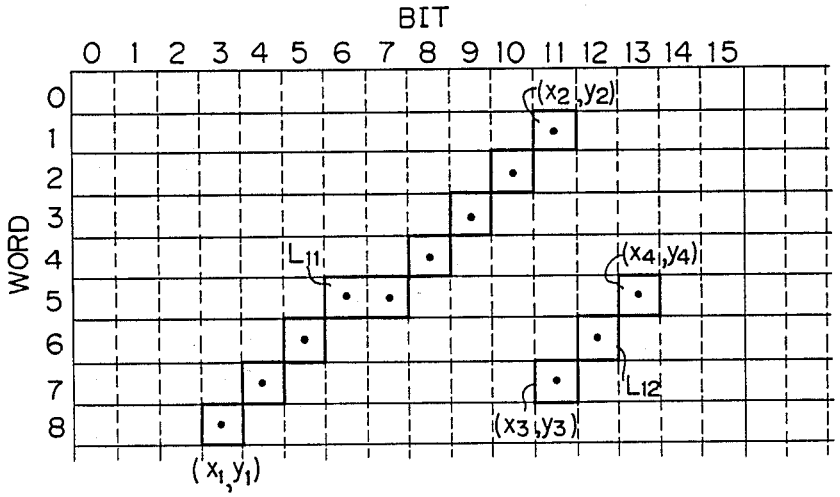
Fig. 1 PRIOR ART
FIG. 1 is a graph of an example of a display pattern in a video memory of a prior art bit map display system.

FIG. 1 is a graph of an example of a display pattern in a video memory of a prior art bit map display system. The video memory includes a plurality of words each consisting of 16 bits in the form of a $1\times16$ bits structure. Each bit corresponds to a single dot or a single picture element (PIXEL) on a display unit. Upon designation of a start coordinate ($x_1$, $y_1$) and an end coordinate ($x_2$, $y_2$), a digital differential analyzer (DDA) successively generates bit data (nine bits in this example). The generated bit data is spread across eight words (word 1 to word 8), as shown by a pattern $L_{11}$, and a memory store operation is carried out nine times, namely, a memory store operation is effected once in words 1-4 and 6-8, and twice for word 5 (two dots are stored therein). If another start coordinate ($x_3$, $y_3$) and another end coordinate ($x_4$, $y_4$) are designated, the DDA successively generates three bits of data, as shown by a pattern $L_{12}$, and a memory controller effects the storage of the pattern in the words 5 to 7 by accessing the memory three times. This type of display system successively and repeatedly carries out the generation of data and the storage of every dot. Therefore, the bit map display system of the above basic pattern generation method results in low speed pattern generation.

Figure 2:
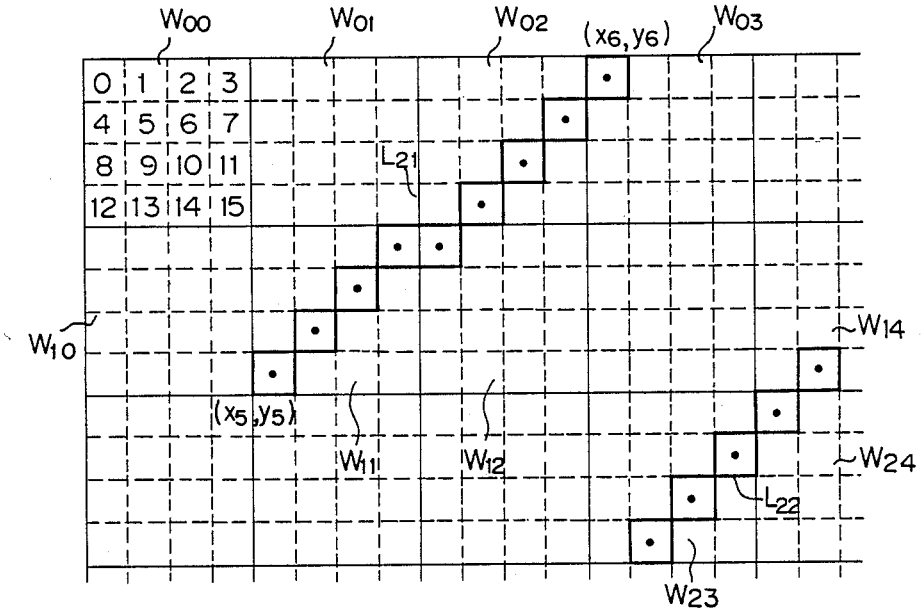
Fig. 2 PRIOR ART
FIG. 2 is a graph of another example of a display pattern in a video memory of another prior art bit map display system.

FIG. 2 is a graph of another example of a display pattern for a video memory of another prior art bit map display system. The video memory includes a plurality of matrix-formed words each consisting of 16 bits, but in a $4\times4$ bits matrix rather than a row as shown in FIG. 1. Each bit corresponds to a single dot.

If the above single pattern generation method is applied thereto, the DDA also generates nine bit data for a pattern $L_{21}$ from a start coordinate ($x_5$, $y_5$) to an end coordinate ($x_6$, $y_6$) similar to the pattern $L_{11}$ in FIG. 1. In this example, the bit data is spread across only 4 words, words $W_{02}$, $W_{03}$, $W_{11}$, and $W_{12}$. A plurality of bits (up to sixteen in a single word) are temporarily saved in a register during the data generation, and stored to the memory by a single store operation. Therefore, the memory is only accessed four times. Compared with FIG. 1, this method realizes shortening of the memory store time.

If the pattern generation is limited to a $4\times4$ bit area (a single word) in each period, the memory store time is constant (a single word store time). In the pattern generation of a pattern $L_{22}$, the DDA generates three bits of data for word $W_{23}$, and one bit of data for words $W_{14}$ and $W_{24}$. Thus, supposing one machine cycle is needed for generating a single bit by the DDA, and four machine cycles are required for storing a single word, and supposing a periodic data processing for every four machine cycles corresponding to a maximum pattern generation time in a single word in view of a simple circuit construction, then there is too much idle time, as shown in FIGS. *3a* to *3c*.

Figure 4:
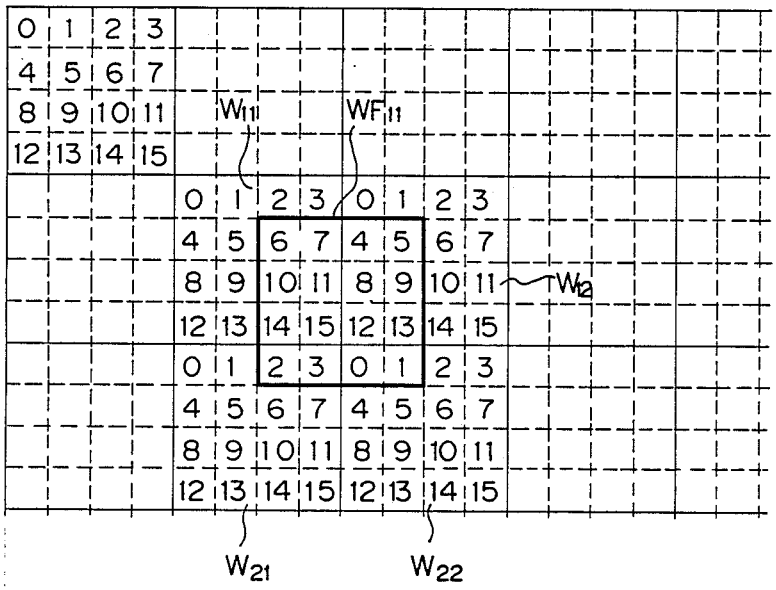
Fig. 4 PRIOR ART
FIG. 4 is a graph of still another example of a display pattern in the video memory of FIG. 2.

In addition to the second prior art example of FIG. 2, if a word can be defined freely on the basis of a start coordinate, as disclosed in U.S. Pat. No. 3,938,102 (Morrin et al., "METHOD AND APPARATUS FOR ACCESSING HORIZONTAL SEQUENCES AND RECTANGULAR SUB-ARRAYS FROM AN ARRAY STORED IN A MODIFIED WORD ORGANIZED RANDOM ACCESS MEMORY SYSTEM", Feb. 10, 1976), i.e., a free word $WF_{11}$ due to the start coordinate is placed on words $W_{11}$, $W_{12}$, $W_{21}$, and $W_{22}$ as shown in FIG. 4, the memory control circuit becomes complex because the free word $WF_{11}$ consists of bits 6, 7, 10, 11, 14, and 15 of a word $W_{11}$, bits 4, 5, 8, 9, 12, and 13 of a word $W_{12}$, bits 2 and 3 of a word $W_{21}$, and bits 0 and 1 of a word $W_{22}$, and this bit sequence and word combination are not orderly. As a result, the disclosed circuit is complex since, for example, a right and left direction circular mechanism, an overall logic circuit, a line logic circuit, etc., must be provided therefor.

Moreover, the disclosed circuit suffers from another disadvantage of the construction of a memory thereof, as follows: a graphic display unit normally has $1280\times1024$ PIXELs, and thus a frame memory therefor usually has a capacity of $2048\times1024$ PIXELs. To realize the frame memory, when a 64 kbit memory chip is used, 32 memory chips, sixteen address systems, and a single word register are required. When a 256 kbit memory chip, now widely utilized, is used, eight memory chips are needed. However, in the disclosed circuit, the sixteen PIXELs forming each region must exist in different independently addressable memory chips. As a result, sixteen 256K memory chips, sixteen address systems, and a single word register are needed. In other words, the capacity of the frame memory must be $2048\times2048$ bits for displaying the $1280\times1024$ PIXELs. This obviously, is an under-utilization of the memory chips.

Now, preferred embodiments of the present invention will be described with reference to the drawings.

Figure 6:
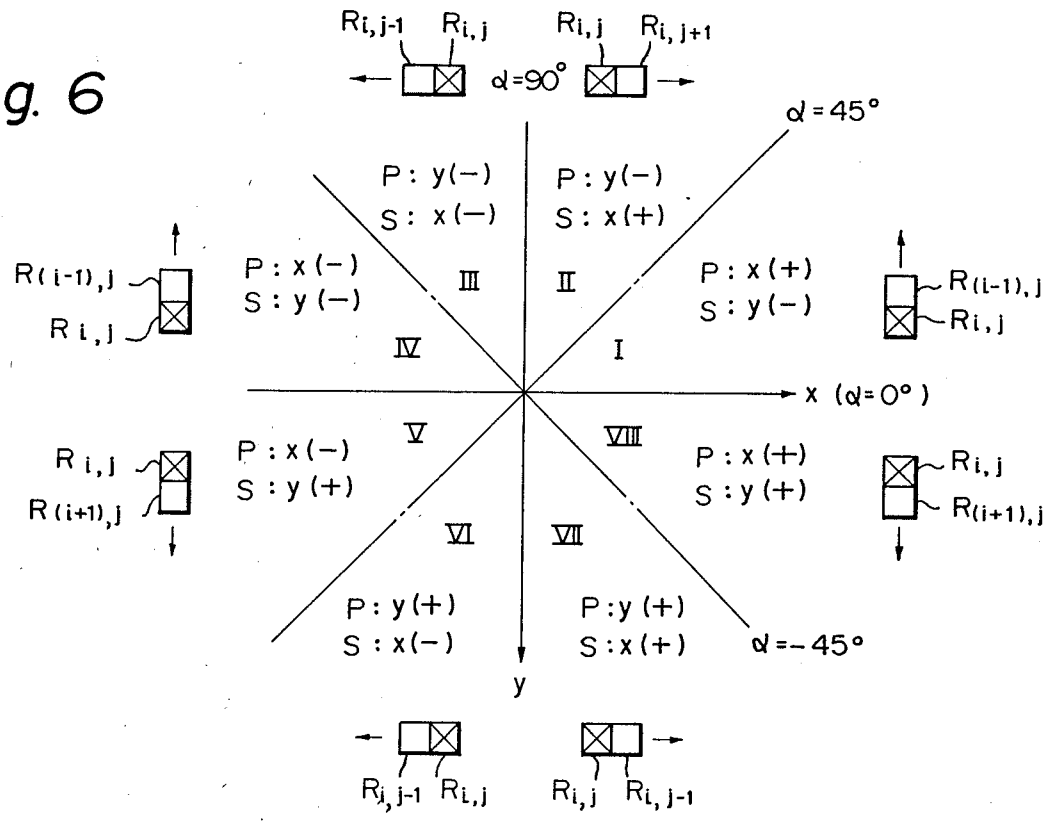
FIG. 6 is a graph representing sections of FIG. 5 and defining the relationship between a primary axis and a subsidiary axis of a vector pattern.

FIG. 5 is a graph representing a rectangular-coordinate of x and y defined in a display plane of a display unit in which vectors are defined. A vector $V_1$ having an angle $\alpha_1$ smaller than 45° with respect to the x-axis has a primary axis of a positive x and a subsidiary axis of a negative y. A vector $V_2$ having an angle $\alpha_2$ larger than 45° with respect to the x-axis has a primary axis of a negative y and a subsidiary axis of a positive x. Similarly, the coordinate is divided into eight sections by 45°, as shown in FIG. 6. In FIG. 6, reference P represents the primary axis and reference S represents the secondary axis in each section.

FIG. 5 is also a graph of the dot pattern defined in the display plane of the display unit. A display area in the display unit consists of a plurality of dots in a matrix form. In FIG. 5, the display areas are formed by matrix-formed memory-display regions. $R_{00}$, $R_{01}$, . . . , $R_{mn}$, each consisting of $4\times4$ dots.

In this embodiment, dot data is generated for a single display region or two consecutive display regions in one of the sections I to VIII in FIG. 6, defined by a gradient of a vector, in each period.

Figure 7A:
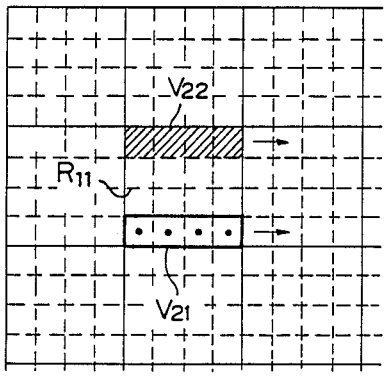
FIGS. 7*a* to 7*d* and FIGS. 8*a* and 8*b* are graphs illustrating a pattern generating principle of the present invention.
Figure 7B:
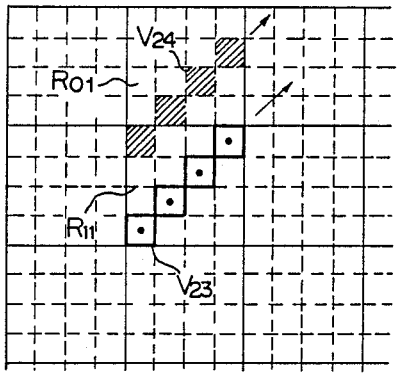
Figure 7C:
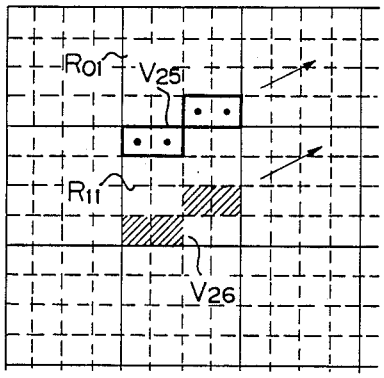
Figure 7D:
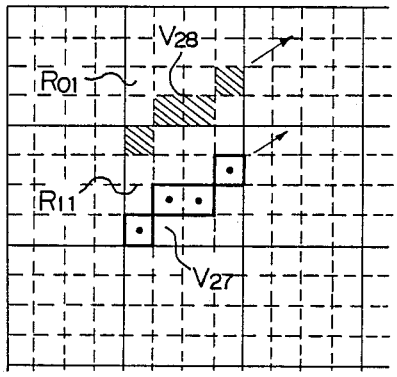

FIGS. *7a* to *7d* are graphs representing vector patterns occupying section I in FIG. 6. In FIGS. *7a* to *7d*, arrows indicate forward directions of the vector patterns. In FIG. *7a*, a horizontal straight vector $V_{21}$ (dotted portions) having an angle of 0° in a region $R_{11}$ has four dot data in the primary axis of x. Another horizontal straight vector $V_{22}$ (shaded portions) also has four dot data. In FIG. *7b*, a vector $V_{23}$ having an angle of 45° (dotted portions) in the region $R_{11}$ has four dot data in the primary axis of x. Another vector $V_{24}$ having an angle of 45° (shaded portions) in the regions $R_{11}$ and $R_{01}$ has one dot data in the region $R_{11}$ and three dot data in the region $R_{01}$ adjacent to the region $R_{11}$ in the forward direction of the subsidiary axis of y, and accordingly, a total of four dot data in the primary axis of x. In FIG. *7c*, a vector $V_{25}$ having an angle of approximately 28.5° (dotted portion) has two dot data in the region $R_{11}$ and two dot data in the region $R_{01}$ adjacent to the region $R_{11}$ in the forward direction of the subsidiary axis of y, and thus also has a total of four dot data in the primary axis of x. Another vector $V_{26}$ in the region $R_{11}$ has four dot data. In FIG. 7*d*, a vector pattern $V_{27}$ having an angle of approximately 37° has four dot data in the region $R_{11}$. Another vector $V_{28}$ also has four dot data in the primary axis of x; one in the region $R_{11}$ and three in the adjacent region $R_{01}$.

Figure 8A:
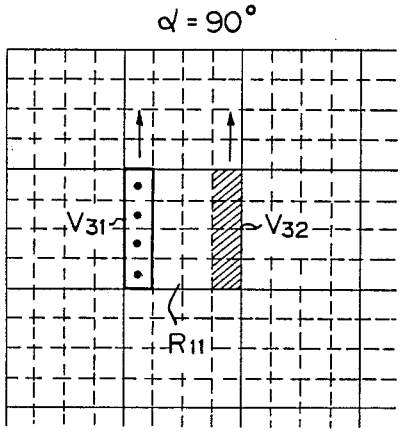
Figure 8B:
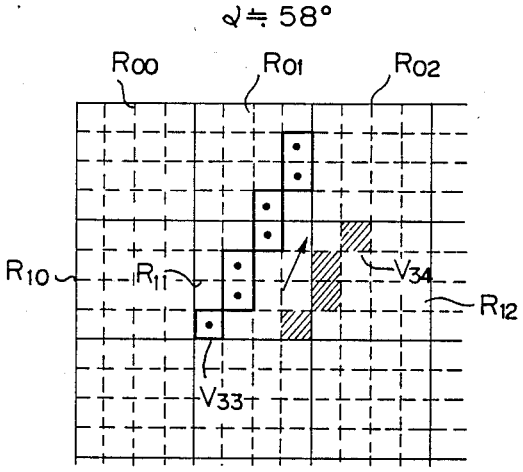

FIGS. 8*a* and 8*b* are graphs representing vector patterns occupying the section II in FIG. 6. In FIG. 8*a*, a vertical straight vector $V_{31}$ (dotted portions) has four dot data in the region $R_{11}$. Another straight vector $V_{32}$ (shaded portions) also has four dot data. In FIG. 8*b*, a vector $V_{33}$ having an angle of approximately 58° (dotted portions) has four dot data in the region $R_{11}$ in the primary axis of y. Another vector $V_{34}$ has one dot data in the region $R_{01}$ and three dot data in the region $R_{12}$ adjacent to the region $R_{01}$.

From the above investigation using specific examples of vector patterns, the following can be derived: when memory regions each having N×N dots are defined in the display plane of the display unit, any vector pattern, in one memory region or two consecutive memory regions which includes temporary start dot data and another region adjacent to the first region in the forward direction of the subsidiary axis shown in FIG. 6, consists of up to N dot data in the primary axis shown in FIG. 6. As a result, it can be seen that the pattern generation at the DDA does not exceed (N+1) dot data in each period. The present invention is primarily characterized by this feature to by which regular control is realized.

Figure 9:
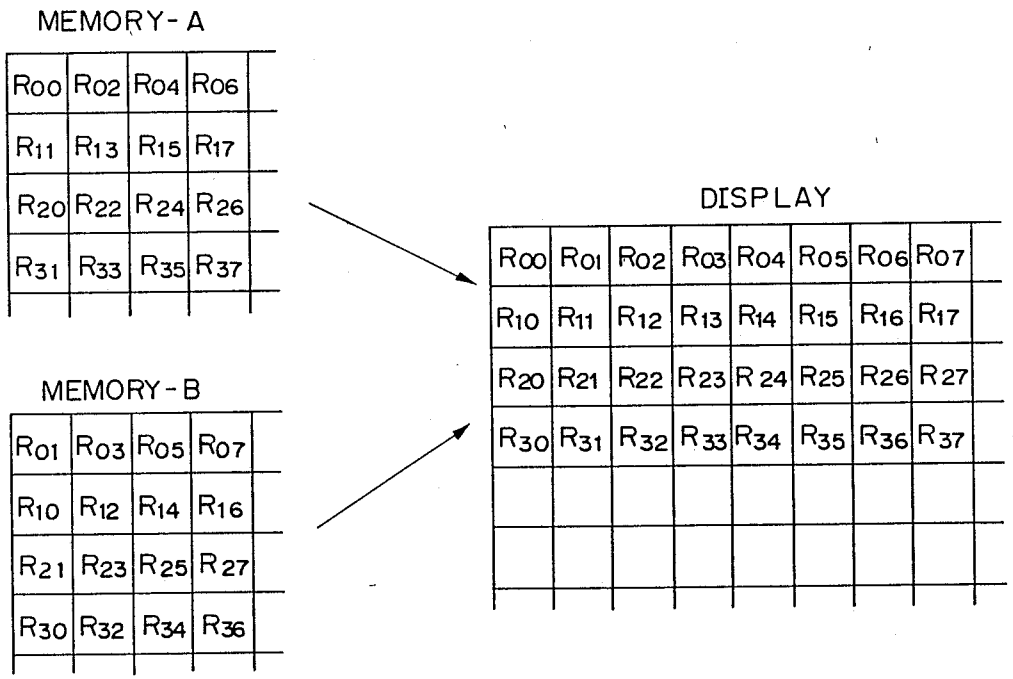
FIG. 9 is a graph representing the relationship between the structure of video memories and a layout of a display unit of the present invention.

On the other hand, since any vector pattern is placed on one memory region or two consecutive memory regions as shown in FIG. 6, in which crossed boxes are basic memory regions and blank boxes are additional memory regions adjacent thereto, when a single quasi region corresponds to a single word of N×N dots, one or two memory accesses may be required to store the generated dot data up to N dot data in the video memory. To shorten the memory access, even for two memory accesses, and to maintain a constant single memory access time, the present invention uses dual video memories, as shown in FIG. 9. In FIG. 9, each video memory stores data for the diagonal memory regions in the display plane, i.e., the first video memory MEMORY-A stores data for the quasi regions $R_{00}$, $R_{02}$, . . . , $R_{11}$, $R_{13}$, . . . , e.g., in the pattern of black boxes of a chess board, and the second video memory MEMORY-B stores data for the memory regions $R_{01}$, $R_{03}$, . . . , $R_{10}$, $R_{12}$, . . . , e.g., in the pattern of white boxes of the chess board. That is, data for adjacent memory regions are each stored in another video memory, and this allows parallel memory accessing at the same time.

Figure 10:
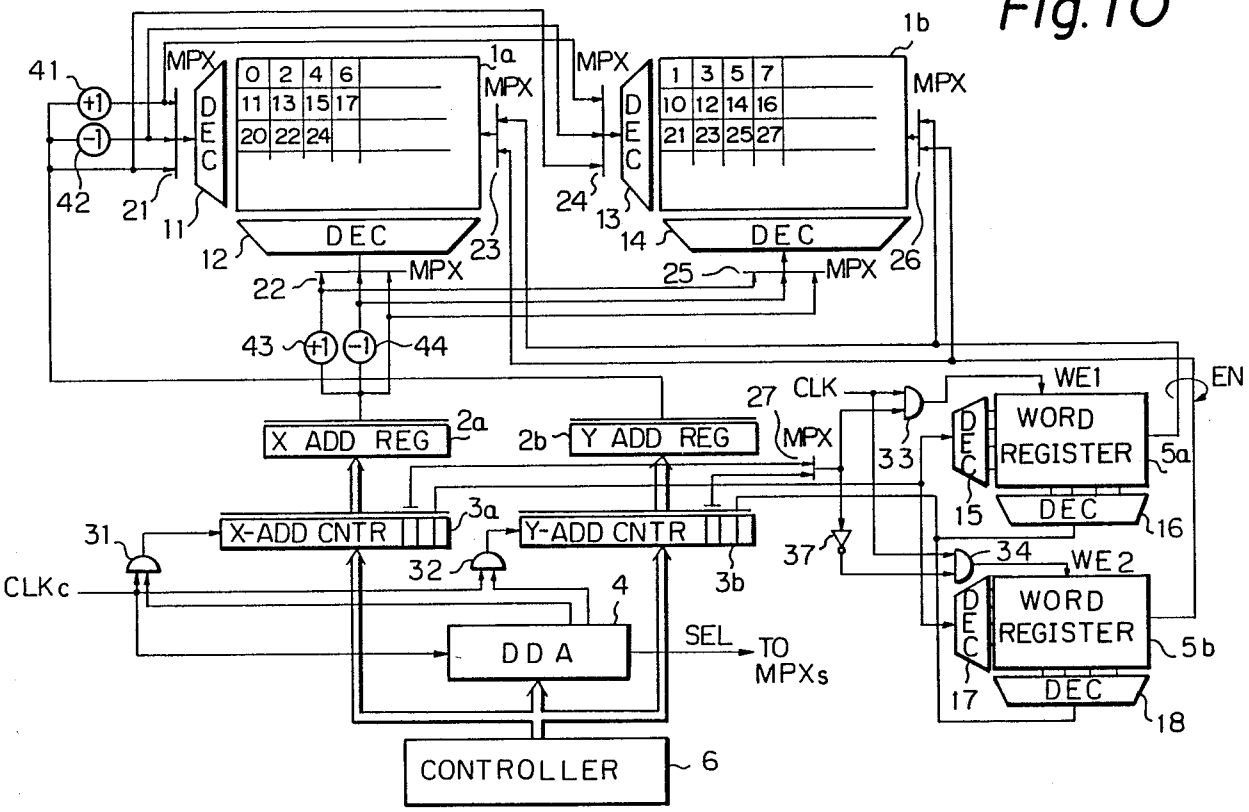
FIG. 10 is a circuit diagram of an embodiment of a vector pattern generation circuit according to the present invention.

FIG. 10 is a circuit diagram of an embodiment of a vector pattern processing circuit of the present invention.

The vector pattern processing circuit in FIG. 10 includes video memories 1*a* and 1*b*, an X address register 2*a*, a Y address register 2*b*, an X address counter 3*a*, a Y address counter 3*b*, a digital differential analyzer (DDA) 4, a controller 6, and word registers 5*a* and 5*b*. The vector pattern processing circuit also includes decoders 11 and 12 for the video memory 1*a*, decoders 13 and 14 for the video memory 1*b*, decoders 15 and 16 for the word register 5*a*, and decoders 17 and 18 for the word register 5*b*. The vector pattern processing circuit includes a multiplexer 21 for multiplexing the Y address for the video memory 1*a*, and a multiplexer 22 for multiplexing the X address for the video memory 1*a*. A multiplexer 24 and a multiplexer 25 are also provided for the video memory 1*b*. A multiplexer 23 is provided between the video memory 1*a* and the word registers 5*a* and 5*b*, and multiplexer 26 is provided between the video memory 1*b* and the word registers 5*a* and 5*b*. Reference 27 denotes a multiplexer; references 31 to 34 denote AND gates; reference 37 denotes an inverter; references 41 and 43 denote increment circuits; and, references 42 and 44 denote decrement circuits.

The increment circuits 41 and 43 and the decrement circuits 42 and 44 are used for designating an adjacent quasi region as set forth above. The multiplexers 21 and 24 select the Y addresses for the video memories 1*a* and 1*b* in response to selector signals from the DDA 4. The multiplexers 22 and 25 select the X addresses for the video memories 1*a* and 1*b* in response to other selection signals from the DDA 4. The multiplexer 23 selects the dot data to be stored in the video memory 1*a* from either the word register 5*a* or the word register 5*b*, in response to a selection signal from the DDA 4. The multiplexer 26 selects the dot data to be stored in the video memory 1*b* from either the word register 5*a* or the word register 5*b* in response to another selection signal from the DDA 4.

The operation of the vector pattern processing circuit in FIG. 10 will be described with reference to FIG. 11, which shows a vector pattern of a start coordinate ($x_{10}$, $y_{10}$) and an end coordinate ($x_{11}$, $y_{11}$) defined in the display plane of the display unit. In this embodiment, each memory region consists of 4×4 dots. Accordingly, each of the word registers 5*a* and 5*b* has a word consisting of 4×4 bits, and each word in the video memories 1*a* and 1*b* consists of 4×4 bits.

Upon receipt of the start coordinate ($x_{10}$, $y_{10}$), the controller 6 sets an X coordinate $x_{10}$ to the X address counter 3*a* and a Y coordinate $y_{10}$ to the Y address counter 3*b*. Then the X coordinate $x_{10}$ is transferred to the X address register 2*a*, and the Y coordinate $y_{10}$ is transferred to the Y address register 2*b*. A start memory region $R_{21}$ in FIG. 11 is defined according to the start coordinate ($x_{10}$, $y_{10}$). Upon receipt of the end coordinate ($x_{11}$, $y_{11}$), the controller 6 sets the same of the DDA 4 and starts the DDA 4.

Figure 11:
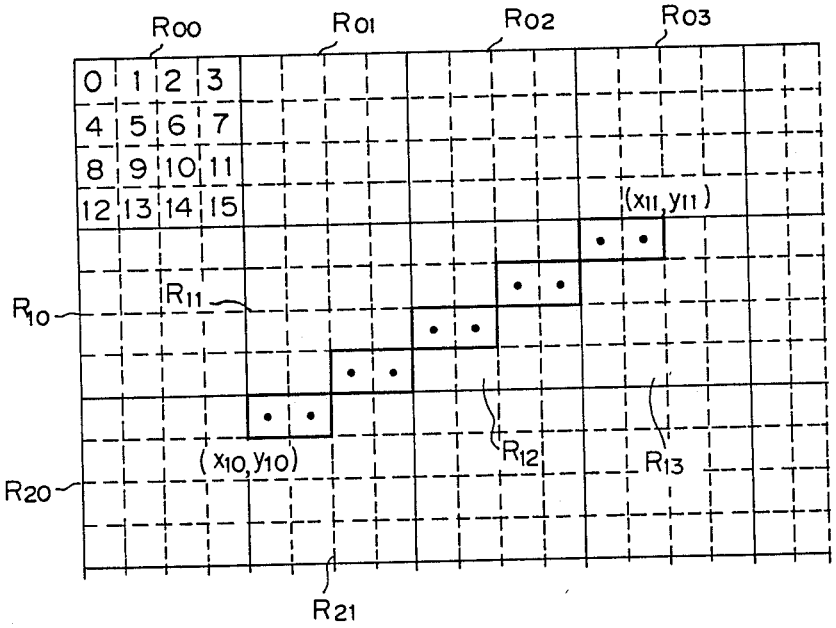
FIG. 11 is a graph representing a vector pattern to be processed by the vector pattern generation circuit of FIG. 10.

The DDA 4 successively generates dot data along the primary axis, i.e., the x axis for the vector pattern in FIG. 11, in the forward direction of the subsidiary axis and in response to a gradient defined by the start coordinate and the end coordinate.

More specifically, first, the DDA 4 determines 1 for the x axis and 1 for the y axis in the region $R_{21}$. The lower three bits in the X- and Y-address counters are not updated and are maintained at one as an initial state. The lower two bits of the X-address counter 3*a* are supplied to the word registers 5*a* and 5*b* through the decoder 15 and 17. Also the lower two bits of the Y-address counter 3*b* are supplied to the word registers 5*a* and 5*b* through the decoder 16 and 18. The multiplexer 27 selects a third low bit of zero of the X-address counter 3*a*. The third low bit signal of zero is converted to logical "1" at the inverter and generates a write enable signal WE2 for the word register 5*b*, together with a clock signal CLK from the DDA 4. As a result, a 1st bit, i.e., 0 bit, in the word register 5*b* is set.

Next, the DDA 4 increases the dot pattern by one for the x axis, but does not increase or decrease the pattern for the y axis on the basis of the gradient. The above increment signal for the x axis is supplied to the X-address counter 3a synchronously with a control clock signal $CLK_c$ through the AND gate 31. The X-address counter 3a counts up by one. Similar to the above, or 2nd bit, i.e., 1 bit, in the word register 5b is set.

The DDA 4 increases the dot pattern by one for the x axis. The X-address counter 3a further counts up one. Thus, the count value therein becomes three. The DDA 4 then generates a value of four, and four pulse signals from the DDA 4 are supplied to the Y-address counter 3b through the AND gate 32 and are counted to four. The third lower bit of the Y-address counter 3b is set at one. The third lower bit having a high level is selected at the multiplexer 27 and generates a write enable signal WE1 for the word register 5a. In this case, the count value of the X-address counter 3a is three and the count value of the Y-address counter 3b is four. As a result, a 15th bit (bit 14) in the word register 5a is set. The decoders 15 and 16 determine the above bit number as, for example, $4\times(4-1)+(3-1)=14$.

The DDA 4 also increases the dot pattern by one for the x axis. The count value of the X-address counter becomes four. However, the count value of the Y-address counter is not decreased but is maintained at four. A 16th bit, i.e., 15 ($=4\times(4-1)+(4-1)$) bit, in the word register 5a is set.

Subsequently, the controller 6 stops the DDA 4 and starts the store operation of the data in the word registers 5a to 5b into the video memories 1a and 1b, since the X-address counter 3a as the primary axis counter in this embodiment reaches four as a maximum value. During the above operation, the DDA 4 outputs the selection signals to the multiplexers 21, 22, 24, and 25 to designate the addresses to the region $R_{11}$ in the video memory 1a and the region $R_{21}$ in the video memory 1b. Also, the DDA 4 outputs the selection signals to the multiplexers 23 and 26 to supply the data in the word register 5a to the video memory 1a and the data in the word register 5b to the video memory 1b. The controller 6 energizes the video memories 1a and 1b to store the data from the word register 5a in the region $R_{11}$ of the video memory 1a and the data from the word register 5b in the region $R_{21}$ of the video memory 1b. Both data are stored in a same address in the video memories 1a and 1b.

The controller 6 again starts the DDA 4, and the DDA 4 generates four dot data for a next quasi region $R_{12}$ in FIG. 11. The four bits of 8, 9, 6, and 7 are set in the word register 5b, and the data in the word register 5b is stored in the region $R_{12}$ of the video memory 1b. In this case, the video memory 1a is not energized.

Finally, the DDA 4 generates two dot data for a quasi region $R_{13}$ in FIG. 11. The two bits of 0 and 1 are set in the word register 5a, and the data in the word register 5a is stored in the region $R_{13}$ of the video memory 1a. The video memory 1b is not energized.

FIGS. 12a to 12c are timing charts of the above operation. In this embodiment, each DDA cycle is 100 ns, a memory store requires 400 ns, and a machine cycle is 100 ns. In FIGS. 12a to 12c, a first calculation for four bit data of 400 ns and a store therefore of 400 ns, represents the regions $R_{21}$ and $R_{11}$, a. second calculation represents the region $R_{12}$, and a third calculation represents the region $R_{13}$. These calculation times do not exceed 500 ns, i.e., are up to 400 ns. Each store time is a constant 400 ns.

After completion of the data generation, the data stored in the video memories 1a (A) and 1b (B) is alternatively output by the following sequence, as shown in FIG. 9; the data of the region $R_{00}$ in the video memory 1a (A); the data of the region $R_{01}$ in another video memory 1b (B); the data of the region $R_{02}$; the data of the region $R_{03}$; and so on. The generated video pattern is displayed on the display unit in a conventional form.

When the size of the display unit is $1280\times1024$ PIXELs, as the previously described, the video memories can be constructed by eight 256k memory chips, each of which has a $64k\times4$ structure, has a common address line, and has four sets of data, because a four bits address in the primary direction of each word in common and a memory chip having a four bit structure, not a sixteen bit structure as set forth above, is used. That is, eight 256k ($64k\times4$) memory chips, two address systems, and two word registers are required. The number of the word registers is higher than that used in the prior art described with reference to FIG. 4, but the number of memory chips and the address systems are greatly reduced.

The above features of the present invention can be applied to a pipe line vector pattern processing circuit in which the DDA and the memory can operate in parallel, instead of the circuit shown in FIG. 10.

FIGS. 13a to 13c are timing charts of the pipe line vector pattern processing circuit for the vector pattern shown in FIG. 11. Here, the pattern processing time is further reduced.

Many widely different embodiments of the present invention may be constructed without departing from the spirit and scope of the present invention. It should be understood that the present invention is not limited to the specific embodiments described in this specification, except as defined in the appended claims.

We claim:

1. A vector pattern processing circuit for a bit map display system including a display unit having a plurality of memory regions in matrix form defined in a plane of said display unit, each memory region forming $N\times N$ dots, comprising:

first and second memory means arranged in parallel for storing a plurality of words formed in a matrix, each word having an $N\times N$ bits structure, said words in said first memory means corresponding to dot data of a first group of diagonally arranged memory regions of said display unit and said words in said second memory means corresponding to dot data of a second group of diagonally arranged memory regions of said display unit;

first word register means, operatively connected to said first memory means, for storing dot data of said first diagonally arranged memory region group;

second word register means operatively connected to said second memory means for storing dot data of said second diagonally arranged memory region group;

vector pattern generation circuit means for receiving start and end coordinates in said diagonally arranged memory regions defining a processing vector pattern, for generating vector pattern dot data arranged in a plane defined by a horizontal axis and a vertical axis perpendicular to said primary axis in response to a gradient of said vector pattern, and for generating control signals for selecting one word from each other of said first and second memory means in accordance with said gradients of said vector pattern;

bit setting circuit means, operatively connected between said first and second word register means and said vector pattern generation circuit means, for energizing one of said first and second word register means in response to said pattern dot data from said vector pattern generation circuit means, and for setting a bit to said energized word register means in each dot data generation time at said vector pattern generation circuit means, so that each of said pattern dot data is set in the corresponding word register means for storing dot data of the corresponding diagonally arranged memory unit; and store control circuit means, operatively connected to said first and second memory means and said vector pattern generation circuit means, for receiving said start coordinate and addressing at least one address of a word in one of said memory means defined by said start coordinate and said control signals, so that at least one data set stored in one of said word register means is stored in said word of the corresponding memory means defined by said address.

2. A vector pattern processing circuit according to claim 1, wherein said store control circuit means includes means for addressing for one word defined by said coordinate and another word in another memory unit and corresponding to a memory region defined in said plane of said display unit adjacent to a memory region of said one word in a forward direction of said vertical axis, when said bit setting is effected to said word register means.

3. A vector pattern processing circuit according to calim 2, wherein said store control circuit means includes means for updating said coordinate in response to a generation of said pattern dot data at said vector pattern generation circuit means.

4. A vector pattern processing circuit according to claim 3, wherein said vector pattern generation circuit means includes a digital differential analyzer.

* * * * *

UNITED STATES PATENT AND TRADEMARK OFFICE

CERTIFICATE OF CORRECTION

PATENT NO. : 4,888,584
DATED : December 19, 1989
INVENTOR(S) : Hisashige Ando

It is certified that error appears in the above-identified patent and that said Letters Patent is hereby corrected as shown below:

Front Page is missing the following U.S. and foreign patents under "References Cited":

U.S. Patents --

4,642,625 2/10/87 Tsunehiro et al.

Foreign Patents --

JP-A-59106066
EP-A-0099989
EP-A-0164880

Signed and Sealed this

Eighteenth Day of December, 1990

*Attest:*

HARRY F. MANBECK, JR.

*Attesting Officer*

*Commissioner of Patents and Trademarks*